US009631352B2

(12) United States Patent
Alcorn

(10) Patent No.: US 9,631,352 B2
(45) Date of Patent: Apr. 25, 2017

(54) TOILET HAVING AUXILIARY DISCHARGE PATH AND VALVE

(71) Applicant: A. Shane Alcorn, Smithfield, UT (US)

(72) Inventor: A. Shane Alcorn, Smithfield, UT (US)

( * ) Notice: Subject to any disclaimer, the term of this patent is extended or adjusted under 35 U.S.C. 154(b) by 0 days.

(21) Appl. No.: 14/630,378

(22) Filed: Feb. 24, 2015

(65) Prior Publication Data

US 2015/0247311 A1 Sep. 3, 2015

Related U.S. Application Data

(60) Provisional application No. 61/947,117, filed on Mar. 3, 2014.

(51) Int. Cl.
*E03D 11/02* (2006.01)
*E03D 9/00* (2006.01)

(52) U.S. Cl.
CPC ..... *E03D 11/02* (2013.01); *E03D 9/00* (2013.01)

(58) Field of Classification Search
CPC ..... E03D 11/02; E03D 11/13; E03D 11/16
USPC ..... 4/427
See application file for complete search history.

(56) References Cited

U.S. PATENT DOCUMENTS

| | | | | |
|---|---|---|---|---|
| 2,016,636 | A * | 10/1935 | Henn | E03D 11/02 4/256.1 |
| 4,709,427 | A | 12/1987 | Laverty | 4/427 |
| 4,974,264 | A | 12/1990 | Brian | 4/300 |
| 5,548,850 | A * | 8/1996 | Geeham | E03D 1/145 4/249 |
| 5,768,719 | A | 6/1998 | Harvey | 4/255.01 |
| 6,782,564 | B1 * | 8/2004 | Cheng | E03D 5/012 4/434 |
| 6,810,902 | B2 * | 11/2004 | Bootka | E03C 1/242 137/2 |
| 2006/0096017 | A1 | 5/2006 | Yamasaki et al. | 4/420 |
| 2010/0287692 | A1 * | 11/2010 | Rampen | E03D 11/10 4/434 |

* cited by examiner

*Primary Examiner* — Janie Loeppke
(74) *Attorney, Agent, or Firm* — Kunzler Law Group, PC

(57) ABSTRACT

The present invention is a toilet having auxiliary discharge path and valve and adapted to prevent accidently overflows of the toilet. The auxiliary discharge valve is actuateable so as to allow the contents of a toilet to bypass the trap of a toilet and flow through the discharge path and into a sewer line.

11 Claims, 8 Drawing Sheets

TOILET HAVING AUXILIARY DISCHARGE PATH AND VALVE

CROSS REFERENCE TO RELATED APPLICATIONS

This U.S. nonprovisional utility patent application claims the benefit under 35 USC §119(e) of U.S. provisional application No. 61/947,117 filed Mar. 3, 2014 which is expressly incorporated herein in its entirety by this reference.

FIELD OF THE INVENTION

The present invention relates to toilets and more especially to toilets adapted to prevent overflow thereof.

BACKGROUND OF THE INVENTION

Toilets are a common plumbing appliance that are widely used throughout the US and the throughout the world. A common problem associated is toilets is clogging or plugging of the toilet and resulting in stoppage of the toilet contents and often overflow of the toilet contents onto the floor near where the toilet is mounted. Such overflow is not only distasteful, it can cause the spread of germs and disease. Part of the cause of toilet clogging is that the trap of the toilet often reduces in diameter so as to create a "bottleneck". Even if the toilet doesn't overflow, unclogging a toilet is typically a time consuming and unpleasant task.

SUMMARY OF THE INVENTION

The present invention is a toilet having auxiliary discharge path and valve. The auxiliary discharge valve is actuateable so as to allow the contents of a toilet to bypass the trap of a toilet and flow through the discharge path and into a sewer line. The auxiliary discharge valve may be any of a variety actuateable valves that provide for the opening and closing of a plumbing passage way. The auxiliary discharge valve may be actuated manually, automatically, by a combination thereof. In the case of automatic valve actuation, the toilet preferably includes a sensor adapted so as to sense if a toilet is filled beyond a predetermined level, and upon sensing such overfill condition, automatically sends a signal to an automatic valve actuator, causing the toilet to discharge the contents of the toilet through the auxiliary path and to the sewer line before the toilet would otherwise overflow. In a preferred embodiment of a manually actuated valve, the auxiliary discharge valve preferably includes a spring bias or like mechanism to cause the auxiliary discharge valve to return to a closed position upon removal of a manual actuation load (e.g. a hand or foot is removed from a valve actuation lever). In a preferred embodiment of an automatically actuated valve, the auxiliary discharge valve is preferably adapted to re-close after a predetermined open dwell period. It is noted that the invention has the added benefit of easier mounting of the toilet to the floor by using the auxiliary path opening as a target for connecting with the sewer line. Further, while the invention reduces the likelihood of toilet removal to unclog a clogged toilet, if the toilet is removed, unlike convention toilets, water can drain from the trap by actuating the auxiliary discharge valve before removing the toilet.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature list is provided below. It is noted that like features are like numbered throughout all of the figures.

FEATURE TABLE

| # | Feature | # | Feature |
|---|---|---|---|
| 10 | Toilet apparatus | 12 | Toilet bowl |
| 14 | Toilet tank | 16 | Toilet lever |
| 18 | Trap | 20 | Auxiliary discharge path |
| 22 | Flapper auxiliary discharge valve | 24 | Actuator |

-continued

FEATURE TABLE

| # | Feature | # | Feature |
|---|---|---|---|
| 26 | Linkage | 27 | Sensor |
| 28 | Sewer line | 29 | Floor |
| 30 | Toilet apparatus | 32 | Toilet bowl |
| 34 | Toilet tank | 36 | Toilet lever |
| 38 | Trap | 40 | Auxiliary discharge path |
| 42 | Sliding auxiliary discharge valve | 44 | Actuator |
| 46 | Linkage | 47 | Sensor |
| 48 | Sewer line | 49 | Floor |
| 50 | Toilet apparatus | 52 | Toilet bowl |
| 54 | Toilet tank | 56 | Toilet lever |
| 58 | Trap | 60 | Auxiliary discharge path |
| 62 | Linear auxiliary discharge valve | 64 | Actuator |
| 66 | Linkage | 67 | Sensor |
| 68 | Sewer line | 69 | Floor |
| 70 | Toilet apparatus | 72 | Toilet bowl |
| 74 | Toilet tank | 76 | Toilet lever |
| 78 | Trap | 80 | Auxiliary discharge path |
| 82 | Plug auxiliary discharge valve | | |
| 88 | Sewer line | 89 | Floor |

Figure 1:
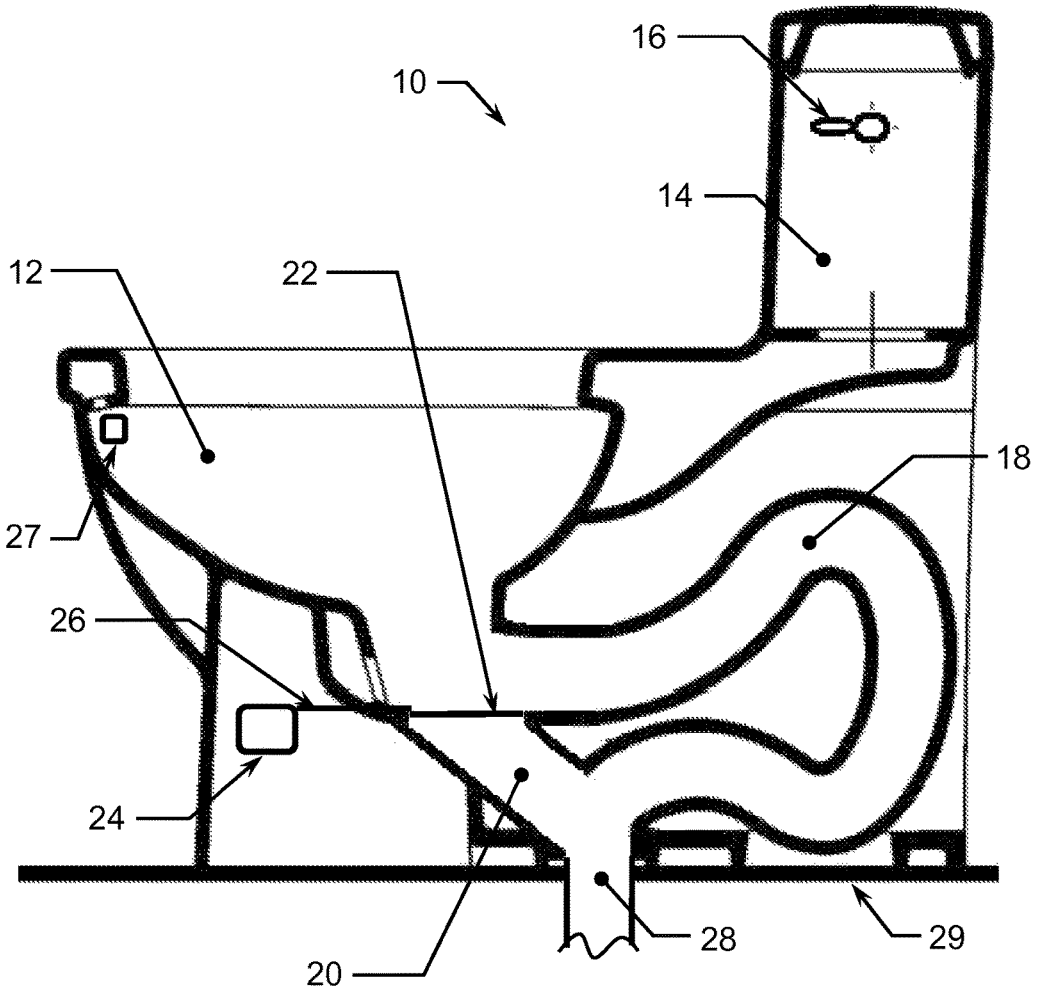
FIG. 1 is a side sectional view of a first embodiment of the toilet apparatus with the auxiliary discharge valve shown in a closed position.
Figure 2:
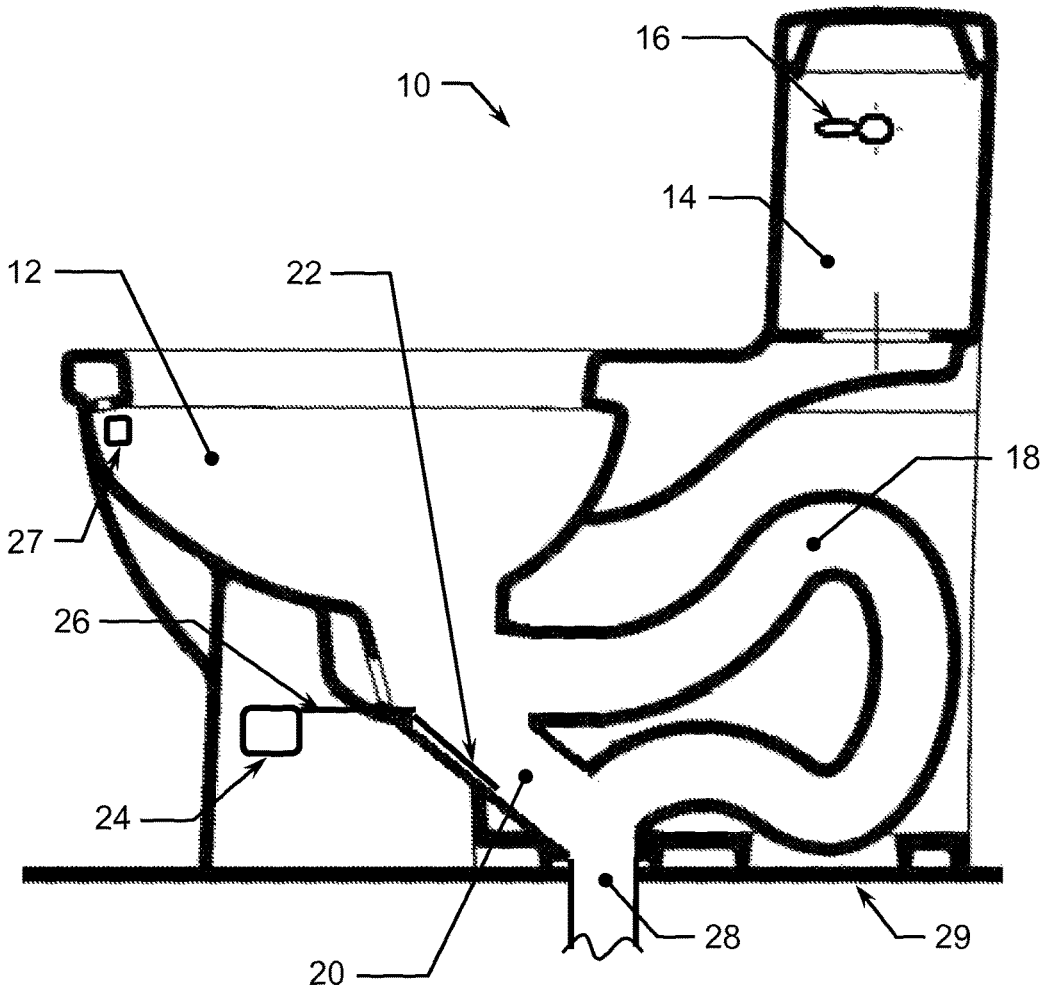
FIG. 2 is a side sectional view of a first embodiment of the toilet apparatus with the auxiliary discharge valve shown in an open (actuated) position.

Referring now to the drawings and in particular to FIGS. 1 and 2, a first embodiment of the invention is a toilet apparatus 10 having an auxiliary discharge path and a flapper type auxiliary discharge valve. Toilet apparatus 10 defines a toilet apparatus having a toilet bowl 12, a toilet tank 14, a toilet lever 16 adapted to discharge water from toilet tank 14 to toilet bowl 12, a trap 18 providing a substantially circuitous discharge path from toilet bowl 12 to a sewer line 28 (and which prevents noxious gases in sewer line 28 from entering toilet bowl 12), an auxiliary discharge path 20 providing a substantially non-circuitous direct discharge path from toilet bowl 12 to a sewer line 28, a flapper type auxiliary discharge valve 22, an actuator 24, a linkage 26 actuatingly connecting auxiliary discharge valve 22 to actuator 24, and a water level sensor 27. It is noted that actuator 24 may be a manually operated actuator (for instance by actuating a hand or foot lever), an automatically operated actuator, or a combination manually and automatically operated actuator.

In practice, the first embodiment of the toilet apparatus 10 functions as a conventional toilet such that when toilet apparatus 10 is flushed, contents of toilet bowl 12 are discharged through trap 18 and into sewer line 30. However, in a manual mode, if toilet apparatus 10 becomes clogged, toilet apparatus 10 may be unclogged by manually actuating the auxiliary discharge valve 22, which causes auxiliary discharge valve 22 to open, and to allow the contents of toilet bowl 12 to discharge or flow from toilet bowl 12 substantially directly to sewer line 28. Auxiliary discharge valve 22 is adapted to return to a closed (default position) after opening. It shall be note that most toilet traps are circuitous (to keep noxious gases in the sewer line from escaping into the toilet bowl) and typically reduce in diameter from the opening at the base of the toilet bowl. In contrast to trap 18, auxiliary discharge path 20 is not circuitous and preferably does not reduce in diameter, thus providing for a more certain discharge. In automatic mode, if sensor 27 senses water, liquid, or like contents above a predetermined level, an actuation signal is sent to actuator 24, which causes auxiliary discharge valve 22 to open, and to allow the contents of toilet bowl 12 to discharge or flow from toilet bowl 12 substantially directly to sewer line 28. Auxiliary discharge valve 22 is adapted to return to a closed (default position) after opening.

Figure 3:
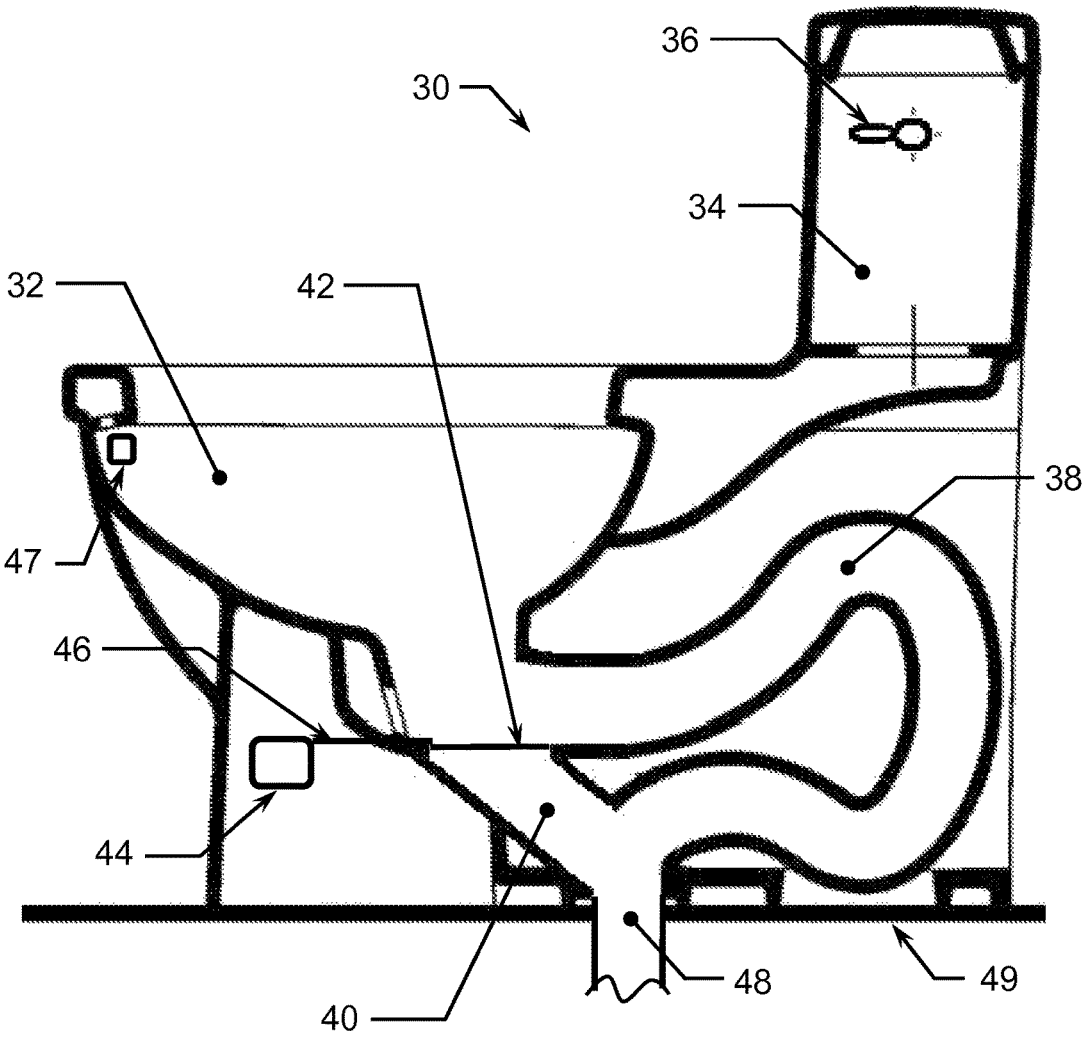
FIG. 3 is a side sectional view of a second embodiment of the toilet apparatus with the auxiliary discharge valve shown in a closed position.
Figure 4:
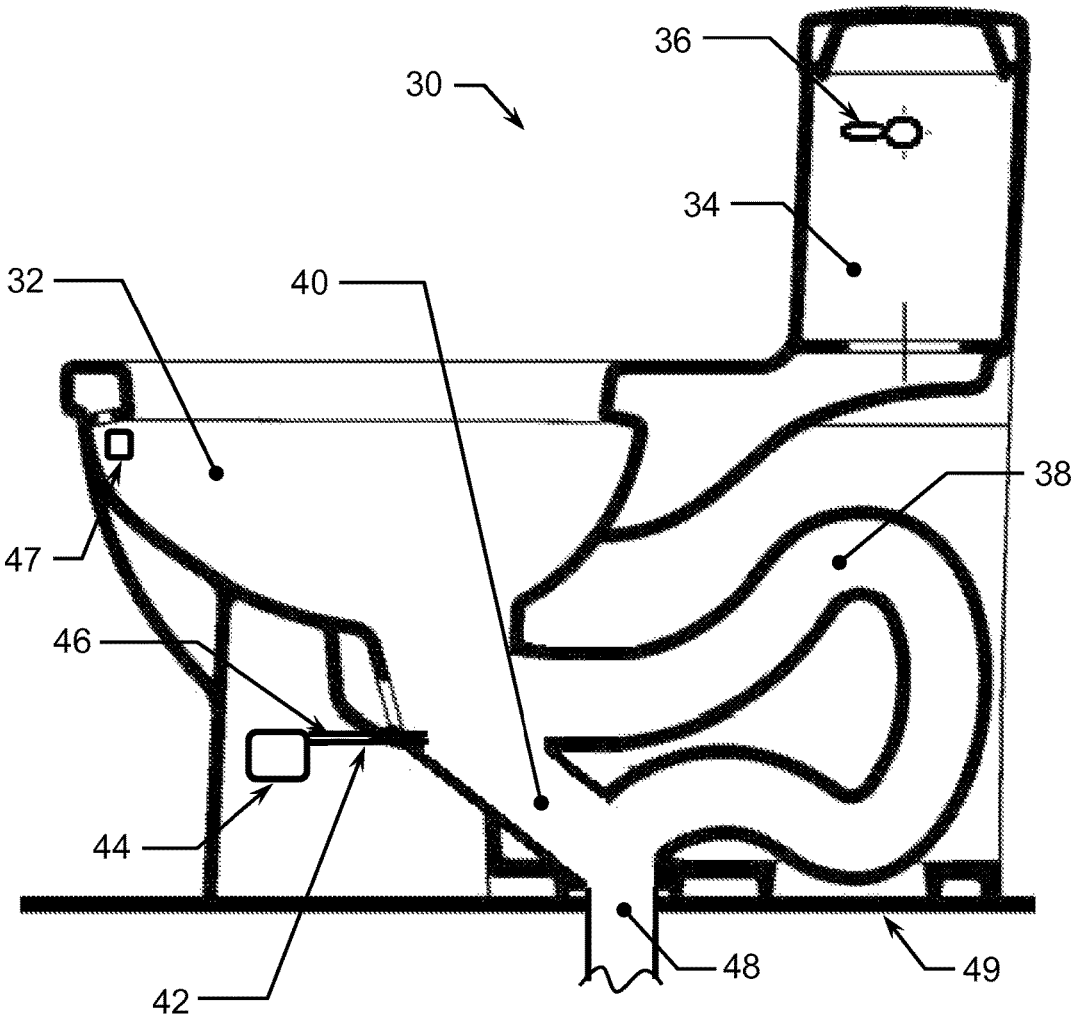
FIG. 4 is a side sectional view of a second embodiment of the toilet apparatus with the auxiliary discharge valve shown in an open (actuated) position.

Referring now to the drawings and in particular to FIGS. 3 and 4, a second embodiment of the invention is a toilet apparatus 30 having an auxiliary discharge path and a sliding type auxiliary discharge valve. Toilet apparatus 30 defines a toilet apparatus having a toilet bowl 32, a toilet tank 34, a toilet lever 36 adapted to discharge water from toilet tank 34 to toilet bowl 32, a trap 38 providing a substantially circuitous discharge path from toilet bowl 32 to a sewer line 48 (and which prevents noxious gases in sewer line 48 from entering toilet bowl 32), an auxiliary discharge path 40 providing a substantially non-circuitous direct discharge path from toilet bowl 32 to sewer line 48, a sliding type auxiliary discharge valve 42, an actuator 44, a linkage 46 actuatingly connecting auxiliary discharge valve 42 to actuator 44, and a water level sensor 47. It is noted that actuator 44 may be a manually operated actuator (for instance by actuating a hand or foot lever), an automatically operated actuator, or a combination manually and automatically operated actuator.

In practice, the second embodiment of the toilet apparatus 30 functions as a conventional toilet such that when toilet apparatus 30 is flushed, contents of toilet bowl 32 are discharged through trap 30 and into sewer line 48. However, in a manual mode, if toilet apparatus 30 becomes clogged, toilet apparatus 30 may be unclogged by manually actuating auxiliary discharge valve 42, which causes auxiliary discharge valve 42 to open, and to allow the contents of toilet bowl 32 to discharge or flow from toilet bowl 32 substantially directly to sewer line 48. Auxiliary discharge valve 42 is adapted to return to a closed (default position) after opening. It shall be note that most toilet traps are circuitous (to keep noxious gases in the sewer line from escaping into the toilet bowl) and typically reduce in diameter from the opening at the base of the toilet bowl. In contrast to trap 38, the auxiliary discharge path 40 is not circuitous and preferably does not reduce in diameter, thus providing for a more certain discharge. In automatic mode, if sensor 47 senses water, liquid, or like contents above a predetermined level, an actuation signal is sent to actuator 44, which causes auxiliary discharge valve 42 to open, and to allow the contents of toilet bowl 32 to discharge or flow from toilet bowl 32 substantially directly to sewer line 48. Auxiliary discharge valve 42 is adapted to return to a closed (default position) after opening.

Figure 5:
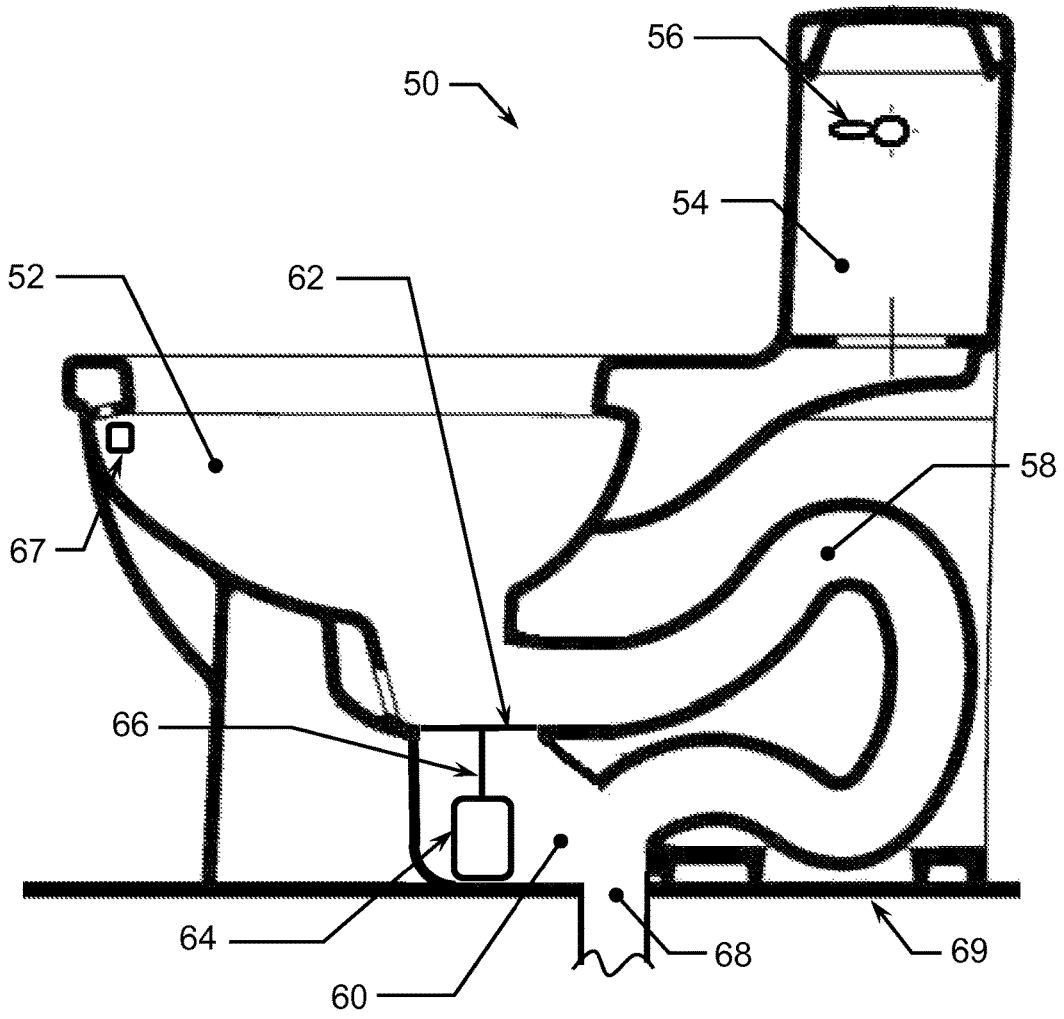
FIG. 5 is a side sectional view of a third embodiment of the toilet apparatus with the auxiliary discharge valve shown in a closed position.
Figure 6:
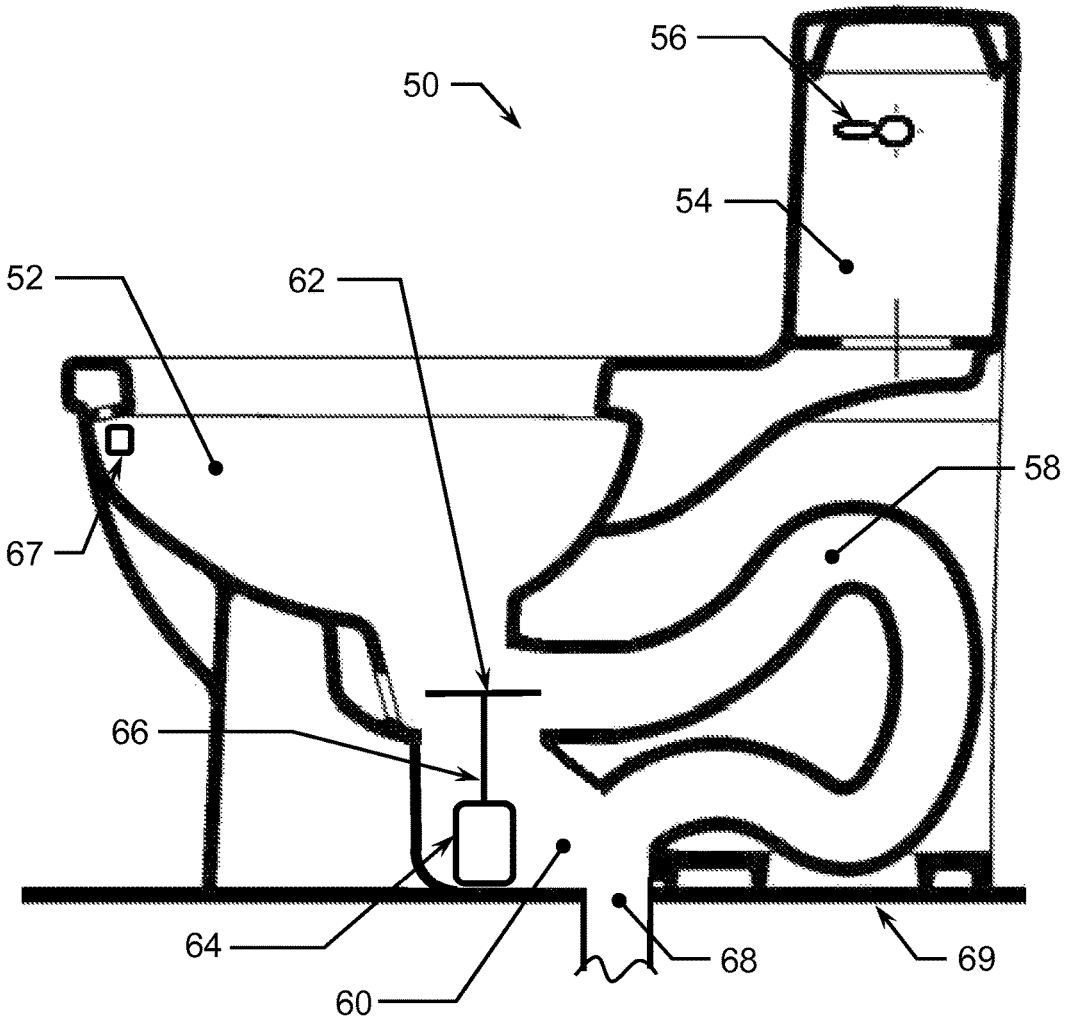
FIG. 6 is a side sectional view of a third embodiment of the toilet apparatus with the auxiliary discharge valve shown in an open (actuated) position.

Referring now to the drawings and in particular to FIGS. 5 and 6, a third embodiment of the invention is a toilet apparatus 50 having an auxiliary discharge path and a "pop up" or linear extension type auxiliary discharge valve. Toilet apparatus 50 defines a toilet apparatus having a toilet bowl 52, a toilet tank 54, a toilet lever 56 adapted to discharge water from toilet tank 54 to toilet bowl 52, a trap 58 providing a substantially circuitous discharge path from toilet bowl 52 to sewer line 68 (and which prevents noxious gases in sewer line 68 from entering toilet bowl 52), an auxiliary discharge path 60 providing a substantially non-circuitous direct discharge path from toilet bowl 52 to sewer line 68, a linear extension type auxiliary discharge valve 62, an actuator 64, a linkage 66 actuatingly connecting auxiliary discharge valve 62 to actuator 64, and a water level sensor 67. It is noted that actuator 64 may be a manually operated actuator (for instance by actuating a hand or foot lever), an automatically operated actuator, or a combination manually and automatically operated actuator. It is further noted that actuator 54 may be a for instance a pneumatic actuator or a hydraulic actuator. In the case of a hydraulic actuator, actuator 64 may be powered by pressurized water.

In practice, the third embodiment of the toilet apparatus 50 functions as a conventional toilet such that when toilet apparatus 50 is flushed, contents of toilet bowl 52 are discharged through trap 58 and into sewer line 68. However, in a manual mode, if toilet apparatus 50 becomes clogged, toilet apparatus 50 may be unclogged by manually actuating auxiliary discharge valve 62, which causes auxiliary discharge valve 62 to open, and to allow the contents of toilet bowl 52 to discharge or flow from toilet bowl 52 substantially directly to sewer line 68. Auxiliary discharge valve 62 is adapted to return to a closed (default position) after opening. It shall be note that most toilet traps are circuitous (to keep noxious gases in the sewer line from escaping into the toilet bowl) and typically reduce in diameter from the opening at the base of the toilet bowl. In contrast to trap 18, auxiliary discharge path 60 is not circuitous and preferably does not reduce in diameter, thus providing for a more certain discharge. In automatic mode, if sensor 67 senses water, liquid, or like contents above a predetermined level, an actuation signal is sent to actuator 64, which causes auxiliary discharge valve 62 to open, and to allow the contents of toilet bowl 52 to discharge or flow from toilet bowl 52 substantially directly to sewer line 68. Auxiliary discharge valve 62 is adapted to return to a closed (default position) after opening.

Figure 7:
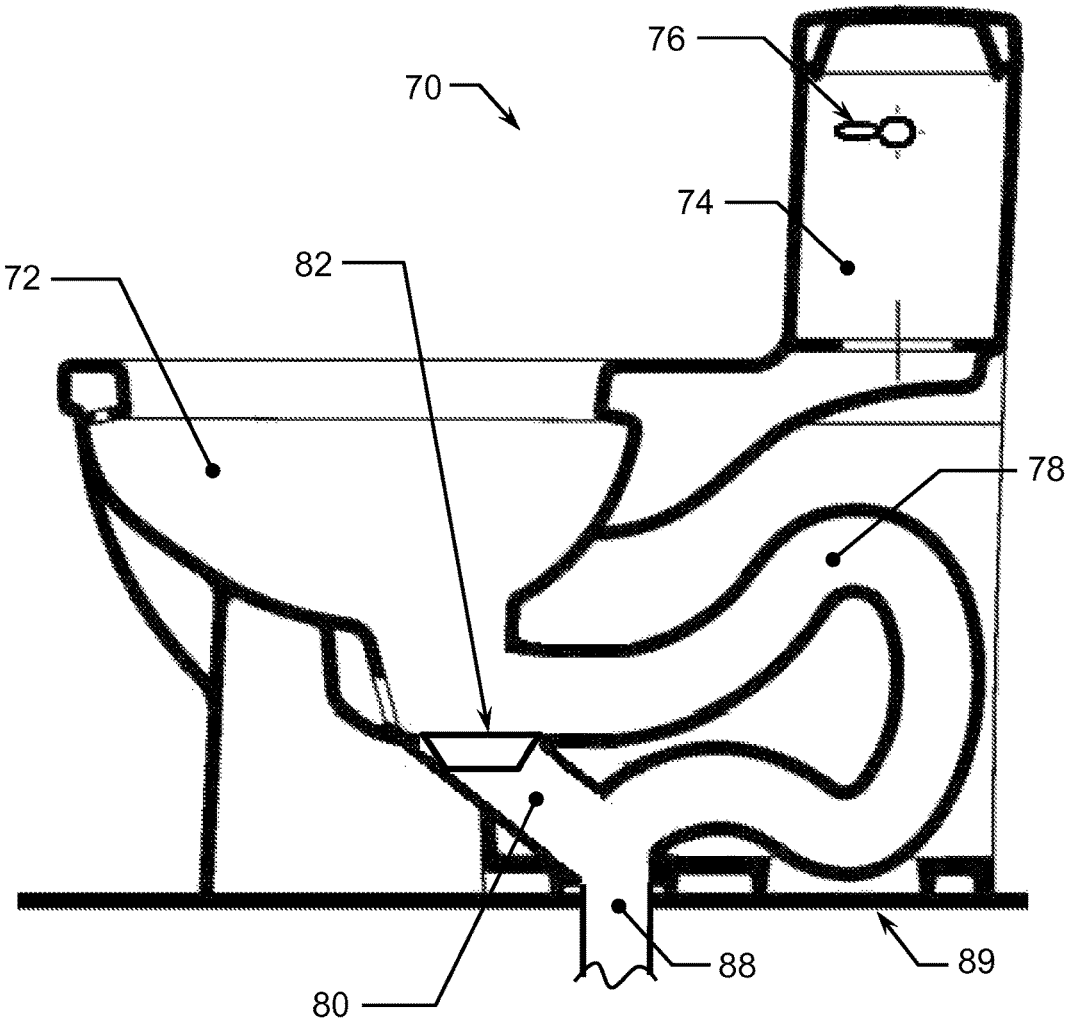
FIG. 7 is a side sectional view of a fourth embodiment of the toilet apparatus with the auxiliary discharge valve shown in a closed position.
Figure 8:
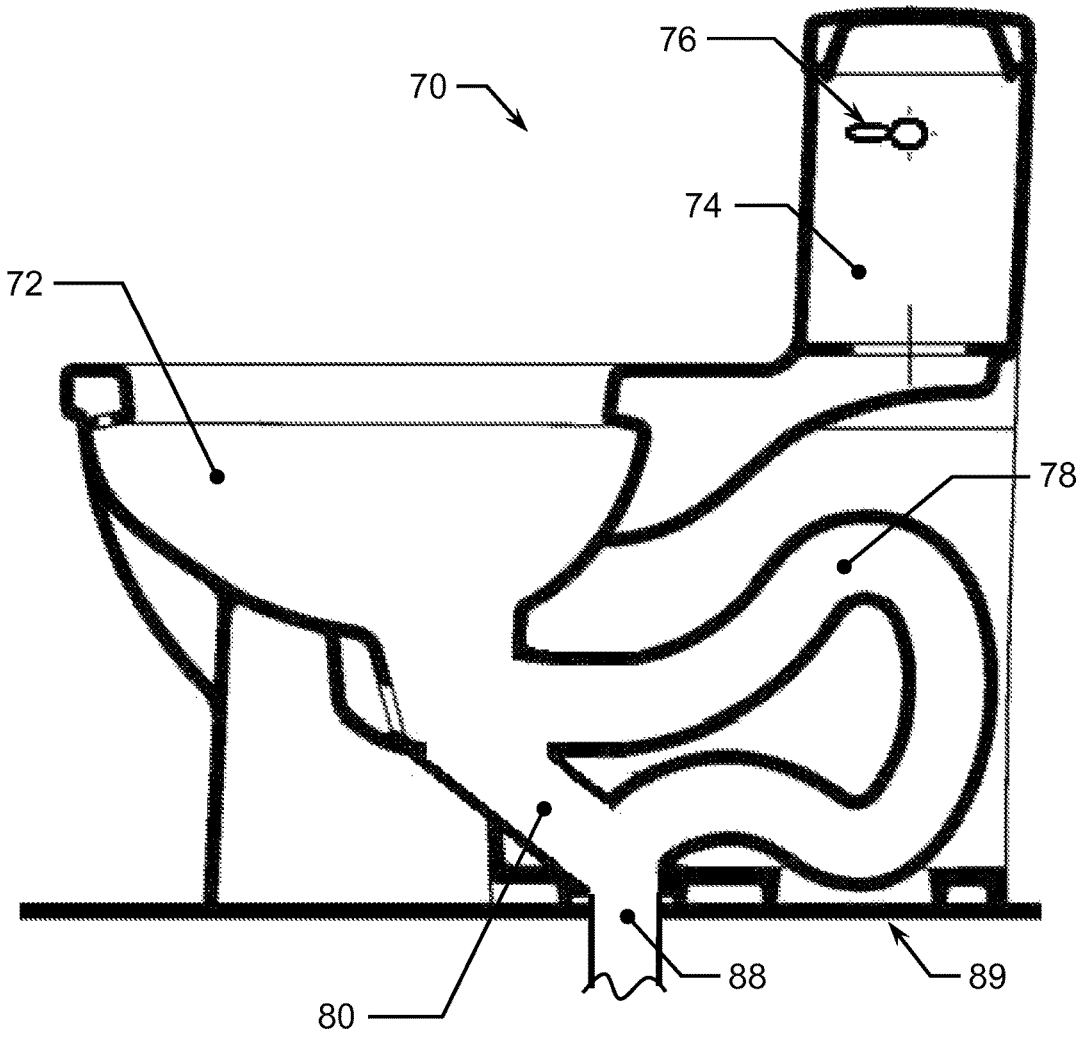
FIG. 8 is a side sectional view of a fourth embodiment of the toilet apparatus with the auxiliary discharge valve shown in an open (removed) position.

Referring now to the drawings and in particular to FIGS. 7 and 8, a fourth embodiment of the invention is a toilet apparatus 70 having an auxiliary discharge path and a core or plug type auxiliary discharge valve. Toilet apparatus 70 defines a toilet apparatus having a toilet bowl 72, a toilet tank 74, a toilet lever 76 adapted to discharge water from toilet tank 74 to toilet bowl 72, a trap 78 providing a substantially circuitous discharge path from toilet bowl 72 to sewer line 88 (and which prevents noxious gases in sewer line 88 from entering toilet bowl 72), an auxiliary discharge path 80 providing a substantially non-circuitous direct discharge path from toilet bowl 72 to sewer line 88, and a core or plug type auxiliary discharge valve 82.

In practice, the fourth embodiment of the toilet apparatus 70 functions as a conventional toilet such that when toilet apparatus 70 is flushed, contents of toilet bowl 72 are discharged through trap 78 and into sewer line 88. However, if toilet apparatus 70 becomes clogged, toilet apparatus 70 may be unclogged by manually removing auxiliary discharge valve 82, which causes the contents of toilet bowl 72 to discharge or flow from toilet bowl 72 substantially directly to sewer line 88. Auxiliary discharge valve 82 is returned to the closed (default position) after opening. It shall be note that most toilet traps are circuitous (to keep noxious gases in the sewer line from escaping into the toilet bowl) and typically reduce in diameter from the opening at the base of the toilet bowl. In contrast to trap 78, auxiliary discharge path 80 is not circuitous and preferably does not reduce in diameter, thus providing for a more certain discharge.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An overflow preventing toilet apparatus for use in preventing toilet overflow and for use in sanitarily discharging contents of a clogged toilet, said toilet apparatus defining a toilet having a toilet bowl, a first trap discharge path, a second non-trap auxiliary discharge path, a non-trap auxiliary discharge valve adapted to selectively control access to said non-trap auxiliary discharge path, a hydraulic actuator, powered by pressurized water and actuatingly connected to said non-trap auxiliary discharge valve, and a sensor adapted to sense the level of contents of said toilet bowl and to send an actuation signal, upon sensing a predetermined contents level, to said hydraulic actuator, wherein said apparatus is adapted such that when a trap discharge path clog causes said contents of said toilet bowl to rise above a predetermined level, said sensor sends an actuation signal to said hydraulic actuator, and said hydraulic actuator automatically actuates said non-trap auxiliary discharge valve to an open position, responsive to said actuation signal, to substantially effect discharge of said contents from said toilet bowl into said non-trap auxiliary discharge path thereby preventing overflow.

2. The toilet apparatus of claim 1, wherein said non-trap auxiliary discharge valve defines at least one of a flapper valve, a sliding valve, a linear extension valve, and a removable core valve.

3. The toilet apparatus of claim 1, wherein after open position actuation of said non-trap auxiliary discharge valve, said non-trap auxiliary discharge valve automatically returns to a closed position after passage of a predetermined amount of time.

4. The toilet apparatus of claim 1, wherein said second non-trap auxiliary discharge path defines a substantially direct from toilet bowl to sewer line discharge path.

5. A toilet apparatus defining a toilet having a toilet bowl, a first trap discharge path, a single second auxiliary discharge path, an auxiliary discharge valve adapted to selectively control access to said auxiliary discharge path, and a hydraulic actuator, powered by pressurized water and actuatingly connected to said non-trap auxiliary discharge valve wherein said hydraulic actuator automatically actuates said auxiliary discharge valve to allow access to said single second auxiliary discharge path responsive to contents in said toilet bowl reaching a predetermined contents level, wherein said apparatus includes a liquid sensor adapted to send, to the hydraulic actuator, an actuation signal upon sensing a predetermined liquid level in said toilet bowl, and wherein in response to the actuation signal the hydraulic actuator automatically actuates said second auxiliary discharge valve to an open position, responsive to said actuation signal, to substantially effect discharge of said contents from said toilet bowl into said second auxiliary discharge path thereby preventing overflow, and wherein an entirety of said second auxiliary discharge path alone is at least as wide as said first trap discharge path.

6. The toilet apparatus of claim 5, wherein said auxiliary discharge valve defines at least one of a flapper valve, a sliding valve, a linear extension valve, and a removable core valve.

7. The toilet apparatus of claim 5, wherein actuation of said auxiliary discharge valve defines at least one of an automatic actuation and a manual actuation.

8. The toilet apparatus of claim 7, wherein after automatic actuation of said auxiliary discharge valve, said auxiliary discharge valve automatically returns to a closed position after passage of a predetermined amount of time.

9. The toilet apparatus of claim 7, wherein said manual actuation is effected by the movement of at least one of a spring biased hand lever and a spring biased foot lever.

10. The toilet apparatus of claim 5, wherein said auxiliary discharge path defines a substantially non-trap non-circuitous direct from toilet bowl to sewer line discharge path.

11. The toilet apparatus of claim 5, wherein emptying of said toilet bowl through said auxiliary discharge path prevents overflow of said toilet bowl.

* * * * *